US006438947B2

(12) United States Patent
Ludwig et al.

(10) Patent No.: US 6,438,947 B2
(45) Date of Patent: Aug. 27, 2002

(54) METHOD FOR ADAPTING A RAW NOX CONCENTRATION VALUE OF AN INTERNAL COMBUSTION ENGINE OPERATING WITH AN EXCESS OF AIR

(75) Inventors: Wolfgang Ludwig, Dolgesheim; Corinna Pfleger, Donaustauf; Hong Zhang, Tegernheim, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/852,349

(22) Filed: May 9, 2001

Related U.S. Application Data

(63) Continuation of application No. PCT/DE99/03519, filed on Nov. 3, 1999.

(30) Foreign Application Priority Data

Nov. 9, 1998 (DE) ..... 198 51 477

(51) Int. Cl.[7] ..... F01N 3/00

(52) U.S. Cl. ..... 60/285; 60/274; 60/295; 60/297

(58) Field of Search ..... 60/274, 295, 297, 60/301, 285

(56) References Cited

U.S. PATENT DOCUMENTS 5,410,873 A * 5/1995 Tashiro et al. ..... 60/276
5,715,679 A * 2/1998 Asanuma et al. ..... 60/276
5,740,669 A * 4/1998 Kinugasa et al. ..... 60/285
5,771,686 A 6/1998 Pischinger et al.
5,778,666 A * 7/1998 Cullen et al. ..... 60/274
5,983,627 A * 11/1999 Asik ..... 60/274
6,041,592 A * 3/2000 Huynh et al. ..... 60/274
6,161,378 A * 12/2000 Hanaoka et al. ..... 60/286
6,244,047 B1 * 6/2001 Brehob et al. ..... 60/295

FOREIGN PATENT DOCUMENTS

| | | |
|---|---|---|
| DE | 19511548 A1 | 6/1996 |
| DE | 19543219 C1 | 12/1996 |
| DE | 19607151 C1 | 7/1997 |
| DE | 19720209 C1 | 6/1998 |
| EP | 0872633 A2 | 10/1998 |

* cited by examiner

*Primary Examiner*—Thomas Denion
*Assistant Examiner*—Binh Tran
(74) *Attorney, Agent, or Firm*—Laurence A. Greenberg; Werner H. Stemer; Ralph E. Locher

(57) ABSTRACT

Values for a raw NOx concentration of an internal combustion engine, that are stored on an operating point basis, are read out from a characteristic map and an adaptation of variations in concentration takes place on the basis of an output signal of an NOx sensor provided downstream of a NOx storage catalyst, either by modification of a reduction factor, which serves for the calculation of a corrected raw NOx concentration from the raw NOx concentration, or by direct correction of the values read out from the characteristic map for the raw NOx concentration with a raw concentration correction factor.

9 Claims, 5 Drawing Sheets

METHOD FOR ADAPTING A RAW NOX CONCENTRATION VALUE OF AN INTERNAL COMBUSTION ENGINE OPERATING WITH AN EXCESS OF AIR

CROSS- REFERENCE TO RELATED APPLICATION

This application is a continuation of copending International application Ser. No. PCT/DE99/03519, filed Nov. 3, 1999, which designated the United States.

BACKGROUND OF THE INVENTION

FIELD OF THE INVENTION

The invention relates to a method for adapting a raw NOx concentration value of an internal combustion engine operating with an excess of air.

To further reduce the fuel consumption of motor vehicles with spark-ignition engines, internal combustion engines which are operated with a lean mixture, at least in selected operating ranges, are increasingly being used.

To meet the exhaust emission limit values required, a special exhaust treatment is necessary in the case of such internal combustion engines. NOx storage reduction catalysts, referred to hereafter as NOx storage catalysts for the sake of simplicity, are used for this purpose. On account of their coating, these NOx storage catalysts are capable during a storing phase, also referred to as a loading phase, of adsorbing from the exhaust gas NOx compounds which are produced in lean combustion. During a regeneration phase, the adsorbed or stored NOx compounds are converted into harmless compounds by adding a reducing agent. CO, $H_2$ and HC (hydrocarbons) may be used as the reducing agent for lean-operated spark-ignition internal combustion engines. These are generated by briefly operating the internal combustion engine with a rich mixture and are made available to the NOx storage catalyst as components of the exhaust gas, whereby the stored NOx compounds in the catalyst are broken down.

The adsorption efficiency of such an NOx storage catalyst decreases as the degree of NOx loading increases. The degree of loading is the term used for the quotient of the absolute NOx loading at a given instant and the maximum NOx storage capacity. The calculated degree of loading can be used for controlling the lean-mix and rich-mix cycles of the internal combustion engine. It is evident that, to ascertain the degree of loading, it is necessary to know as accurately as possible both the loading at a given instant and the maximum storage capacity.

The maximum storage capacity can be ascertained on an engine test bench by measuring the NOx stored per unit of time until a state of saturation is reached, while it is not possible for the NOx storage catalyst to become saturated in a motor vehicle for emission reasons. However, this storage capability is subject to an aging process, so that it is necessary to adapt it over the mileage covered by the vehicle. For this purpose, either the value for the loading at a given instant and/or a very accurate value for the raw NOx emission of the internal combustion engine is required. Raw emmissions are generally taken as meaning the emission without exhaust treatment.

One possibility for ascertaining the raw NOx concentration values is to measure a reference internal combustion engine on a test bench and to store the data in suitable characteristic maps. However, reading out from these characteristic maps only produces meaningful results if the raw NOx concentration values of different internal combustion engines of a series do not vary too much. If the variations in the raw NOx concentration values exceed a certain degree, adaptation of the raw NOx concentration values of the internal combustion engine in the motor vehicle is necessary.

SUMMARY OF THE INVENTION

It is accordingly an object of the invention to provide a method for adapting a raw NOx concentration value of an internal combustion engine which overcomes the above-mentioned disadvantages of the heretofore-known methods of this general type and which allows to perform the adapting of the raw NOx concentration values in a simple way.

With the foregoing and other objects in view there is provided, in accordance with the invention, a method for adapting a raw Nox concentration value of an internal combustion engine operating at least in given operating ranges with an excess of air, wherein the method includes the steps of:

- providing an NOx storage reduction catalyst in an exhaust-gas duct of an internal combustion engine;
- adsorbing, with the NOx storage reduction catalyst, NOx during a storage phase, when the internal combustion engine is operated with a lean air-fuel mixture;
- catalytically converting, with the NOx storage reduction catalyst, NOx stored during the storage phase in a regeneration phase by adding a regenerating agent;
- providing an NOx sensor downstream of the NOx storage reduction catalyst;
- storing a raw NOx concentration value based on operating parameters of the internal combustion engine in a characteristic map of a memory device of a control device controlling the internal combustion engine;
- reading out the raw NOx concentration value from the characteristic map while operating the internal combustion engine; and
- adapting, during a cycle including the storage phase and the regeneration phase, the raw NOx concentration value read out from the characteristic map based on an output signal of the NOx sensor.

In other words, the object of the invention is achieved by a method for adapting a raw NOx concentration value of an internal combustion engine operating at least in certain operating ranges with an excess of air, in which:

- provided in an exhaust-gas duct of the internal combustion engine is an NOx storage reduction catalyst, which adsorbs NOx during a storage phase, when the internal combustion engine is operated with a lean air-fuel mixture, which catalytically converts the stored NOx in a regeneration phase, with regenerating agent being added,
- provided downstream of the NOx storage reduction catalyst is an NOx sensor,
- the raw NOx concentration value is stored on the basis of operating parameters of the internal combustion engine in a characteristic map of a memory device of a control device controlling the internal combustion engine, wherein the raw NOx concentration value read out from the characteristic map during operation of the internal combustion engine is adapted during a cycle, formed of the storage phase and the regeneration phase, on the basis of the output signal of the NOx sensor.

The method according to the invention provides that the operating-point-dependent values for the raw NOx concentration of the internal combustion engine are read out from a characteristic map and the adaptation of the variations in concentration takes place on the basis of the output signal of an NOx sensor provided downstream of the NOx storage catalyst, either by modification of a reduction factor, which serves for the calculation of the corrected raw NOx concentration from the raw NOx concentration values, or by direct correction of the values read out from the characteristic map for the raw NOx concentration with a raw concentration correction factor.

Another mode of the invention includes the step of adapting the raw NOx concentration value by changing a reduction factor applied to the raw NOx concentration value, the reduction factor taking into account a steady-state conversion concentration converted by the NOx storage reduction catalyst during a lean operation of the internal combustion engine.

A further mode of the invention includes the step of determining a leakage amount in a lean phase by measuring an NOx concentration downstream of the NOx storage reduction catalyst with the NOx sensor and by integrating the NOx concentration over a duration of the lean phase, calculating a storage amount in the lean phase during a rich phase following the lean phase, calculating an integral of a corrected NOx concentration over the lean phase based on the raw NOx concentration value and the reduction factor, forming a ratio ((DB+SM)/IKK) of a sum of the leakage amount and the storage amount to the integral of the corrected NOx concentration over the lean phase, selectively changing a correction factor for the reduction factor and keeping the correction factor for the reduction factor unchanged dependent on a value of the ratio, and multiplying the reduction factor by the correction factor.

Yet a further mode of the invention includes the step of calculating a corrected raw NOx concentration from an adapted reduction factor by calculating a product of a difference between 1 and the adapted reduction factor and the raw NOx concentration value read out from the characteristic map.

A further mode of the invention includes the step of multiplying the raw NOx concentration value read out from the characteristic map directly with a correction factor for obtaining a pre-corrected value for a raw NOx concentration, and adapting the raw NOx concentration value by changing the correction factor.

Another mode of the invention includes the step of sensing a leakage amount in a lean phase by measuring, with the NOx sensor, an NOx concentration downstream of the NOx storage reduction catalyst and by integrating the NOx concentration over a duration of the lean phase, calculating, during a rich phase following the lean phase, a storage amount in the lean phase, calculating an integral of a corrected NOx concentration over the lean phase based on the raw NOx concentration value and a reduction factor, forming a ratio of a sum of the leakage amount and the storage amount to the integral of the corrected NOx concentration over the lean phase, and selectively changing the correction factor for the raw NOx concentration value and keeping the correction factor for the raw NOx concentration value unchanged dependent on a value of the ratio.

A further mode of the invention includes the step of calculating a corrected raw NOx concentration from the pre-corrected value for the raw NOx concentration by calculating a product of a difference between 1 and the reduction factor and the pre-corrected value for the raw NOx concentration.

Another mode of the invention includes the step of storing the reduction factor in a further characteristic map based on a temperature of the NOx storage reduction catalyst.

Other features which are considered as characteristic for the invention are set forth in the appended claims.

Although the invention is illustrated and described herein as embodied in a method for adapting a raw NOx concentration value of an internal combustion engine operating with an excess of air, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS:

For the sake of simplicity, the expression NOx concentration is used here for the expression raw NOx concentration value.

Figure 1:
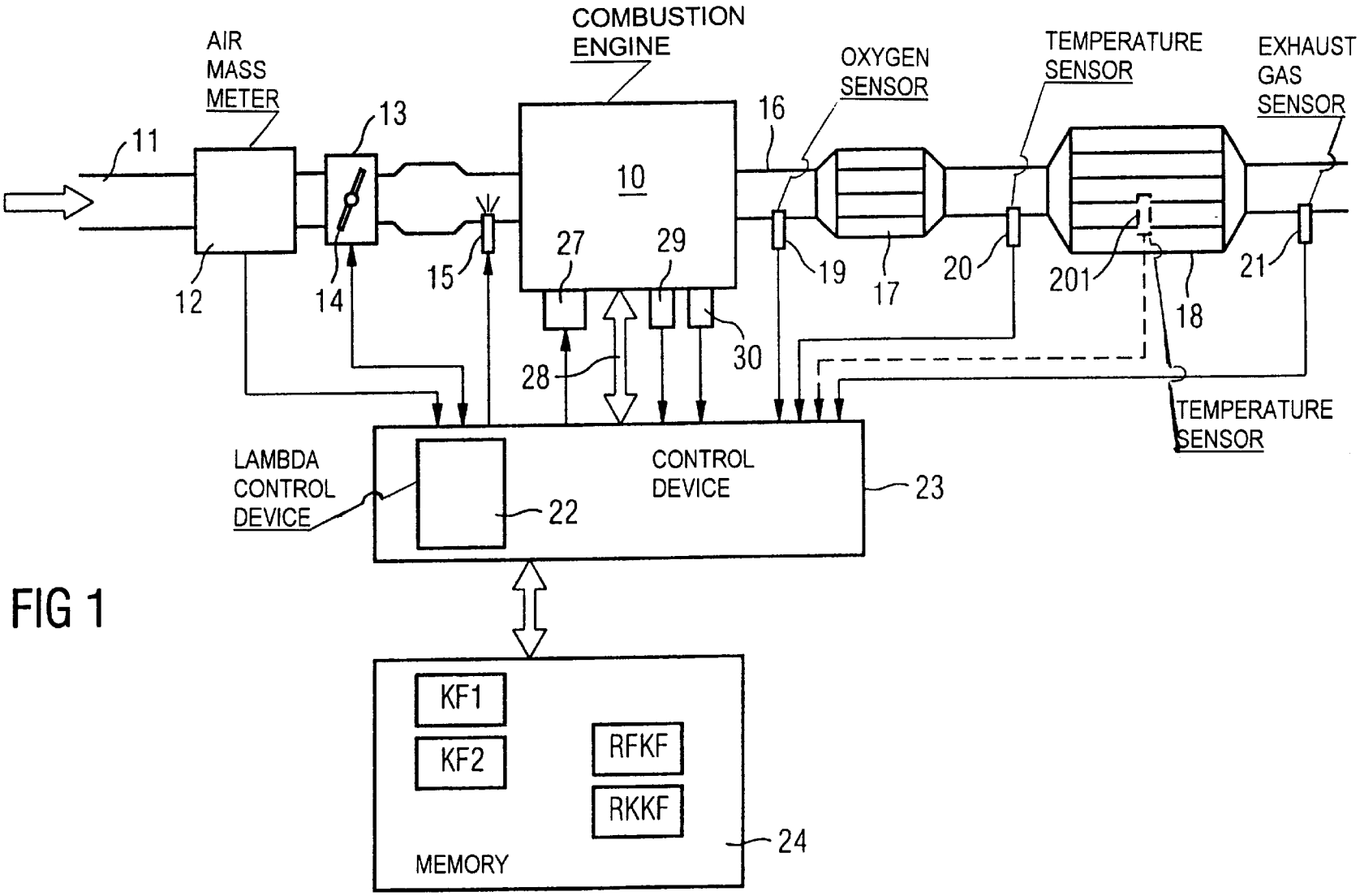
FIG. 1 is a schematic diagram of a lean-mix internal combustion engine with an NOx storage catalyst according to the invention.

Referring now to the figures of the drawings in detail and first, particularly, to FIG. 1 thereof, there is shown, in the form of a block diagram, a lean-mix internal combustion engine with an NOx exhaust treatment system for which the method according to the invention is used.

Only the components which are necessary for understanding the invention are represented here.

The lean-mix internal combustion engine 10 is fed an air/fuel mixture via an intake port 11. Provided one after the other in the intake port 11, seen in the direction of flow of the air taken in, are a load sensor in the form of an air-mass meter 12, a throttle-valve block 13 with a throttle valve 14 and a throttle-valve sensor (not represented) for sensing the opening angle of the throttle valve 14, and a set of injection valves 15 corresponding to the number of cylinders, only one of which valves is shown. The method according to the invention can also be used, however, for a system in which the fuel is injected directly into the respective cylinders (direct injection).

On the output side, the internal combustion engine 10 is connected to an exhaust duct 16. Provided in this exhaust duct 16 is an exhaust treatment system for lean exhaust gas. It includes a primary catalyst 17 (3-way catalyst), provided close to the internal combustion engine 10, and an NOx storage catalyst 18, provided downstream of the primary catalyst 17 in the direction of flow of the exhaust gas.

The sensor equipment for the exhaust treatment system includes an oxygen-measuring sensor (transducer) 19 upstream of the primary catalyst 17, a temperature sensor 20 in the connecting pipe between the primary catalyst 17 and the NOx storage catalyst 18 close to the inlet region of the same and a further exhaust-gas sensor 21 downstream of the NOx storage catalyst 18.

Instead of measuring with the temperature sensor 20, which senses the temperature of the exhaust gas and from the signal of which the temperature of the NOx storage catalyst 18 can be calculated through the use of a temperature model, it is also possible to measure the temperature of the NOx storage catalyst directly. In FIG. 1, such a temperature sensor 201, which measures the temperature of the monolith of the NOx storage catalyst 18 directly, is depicted by dashed lines.

A further possibility is for the temperature of the monolith of the NOx storage catalyst 18 to be calculated through the use of an exhaust-gas temperature model, using some or all of the following parameters, such as engine speed, load, ignition angle, air ratio, exhaust recirculation rate, intake-air temperature, coolant temperature, as input variables for this model. As a result, it is possible to dispense with the use of a temperature sensor 20.

The calculation or measurement of the temperature of the NOx storage catalyst 18 is required for controlling the system optimally in terms of consumption and emission. Based on this measured, calculated or modelled temperature signal, catalyst-heating or catalyst-protecting measures are also initiated.

Preferably used as the oxygen-measuring sensor 19 is a broadband lambda probe, which emits a constant, for example linear, output signal in dependence on the oxygen content in the exhaust gas. With the signal of this broadband lambda probe, the air ratio is adjusted during the lean operation and during the regeneration phase with a rich mixture in a way corresponding to the setpoint presettings. This function is performed by a lambda control device 22 known per se, which is preferably integrated in a control device 23 controlling the operation of the internal combustion engine 10.

Such electronic control devices, which generally include a microprocessor and undertake not only the fuel injection and the ignition but also many other open-loop and closed-loop control tasks, including the control of the exhaust treatment system, are known per se, so that only the construction relevant in connection with the invention and the way in which it operates are discussed below. In particular, the control device 23 is connected to a memory device 24, in which, inter alia, various characteristic curves or characteristic maps KF1, KF2 and also correction factors RFKF and RKKF are stored, the respective significance of which is explained in more detail on the basis of the description of the figures below.

The temperature sensor 29 senses a signal corresponding to the temperature of the internal combustion engine, for example by measuring the coolant temperature. The speed of the internal combustion engine is sensed with the aid of a sensor 30 sensing markings of the crankshaft or of a transmitter wheel connected to it.

The output signal of the air-mass meter 12 and the signals of the throttle-valve sensor, of the oxygen-measuring sensor 19, of the exhaust-gas probe 21, of the temperature sensors 20, 29 and of the speed sensor 30 are fed to the control device 23 via corresponding connection lines.

For the open-loop and closed-loop control of the internal combust ion engine 10, the control device 23 is not only connected to an ignition device 27 for the air-fuel mixture, but also to further sensors and actuators via an only schematically represented data and control line 28.

Provided downstream of the NOx storage catalyst 18 in the exhaust-gas duct is an exhaust-gas sensor in the form of an NOx sensor 21, the output signal of which is used for controlling the storage regeneration and for adapting model variables, such as for example the oxygen storage capacity and NOx storage capacity of the NOx storage catalyst 18, and also for sensing the aging state of the NOx storage catalyst. In addition, if need be the raw NOx emission of the internal combustion engine is adapted with the output signal of the NOx sensor 21.

By executing stored control routines in the control device 23, the parameters already mentioned are used inter alia for detecting the load state of the internal combustion engine, for determining and adapting the raw NOx emission of the internal combustion engine and also for determining the degree of loading of the NOx storage catalyst.

The total amount of NOx emitted during a lean phase of the internal combustion engine can be divided into the following parts:

- One part is converted into less harmful substances by the exhaust treatment system even in lean operation. This fraction is referred to hereafter as the steady-state conversion amount SU.
- Another part is stored in the NOx storage catalyst and is referred to hereafter as the storage amount SM.
- A third part is emitted into the atmosphere. This fraction is referred to hereafter as the leakage amount DB.

If, instead of the integral of this total amount of NOx over the time period of a lean phase, the raw NOx concentration at a given instant is considered, this can also be divided in a way analogous to the procedure described above into

- a steady-state conversion concentration SK inducing the steady-state conversion SU,
- a storage concentration SPK inducing the storage amount SM and
- a neither converted nor stored post-catalyst concentration NK.

The amounts of NOx mentioned above, SU, SM and DB, can be formed from the respective concentrations by integration over time.

Corrected raw NOx concentration KK is understood hereafter as meaning the raw NOx concentration less the steady-state conversion concentration SK. The steady-state conversion concentration SK is determined through the use of a reduction factor RF. The corrected raw NOx concentration KK is defined as the product of the difference between one and the reduction factor RF and the raw NOx concentration RK of the internal combustion engine: $KK=(1-RF)*RK$.

To control the catalyst through the use of calculating the degree of loading and to carry out aging adaptation of the storage capacity, it is necessary to know the corrected raw NOx concentration KK as accurately as possible.

Figure 2:
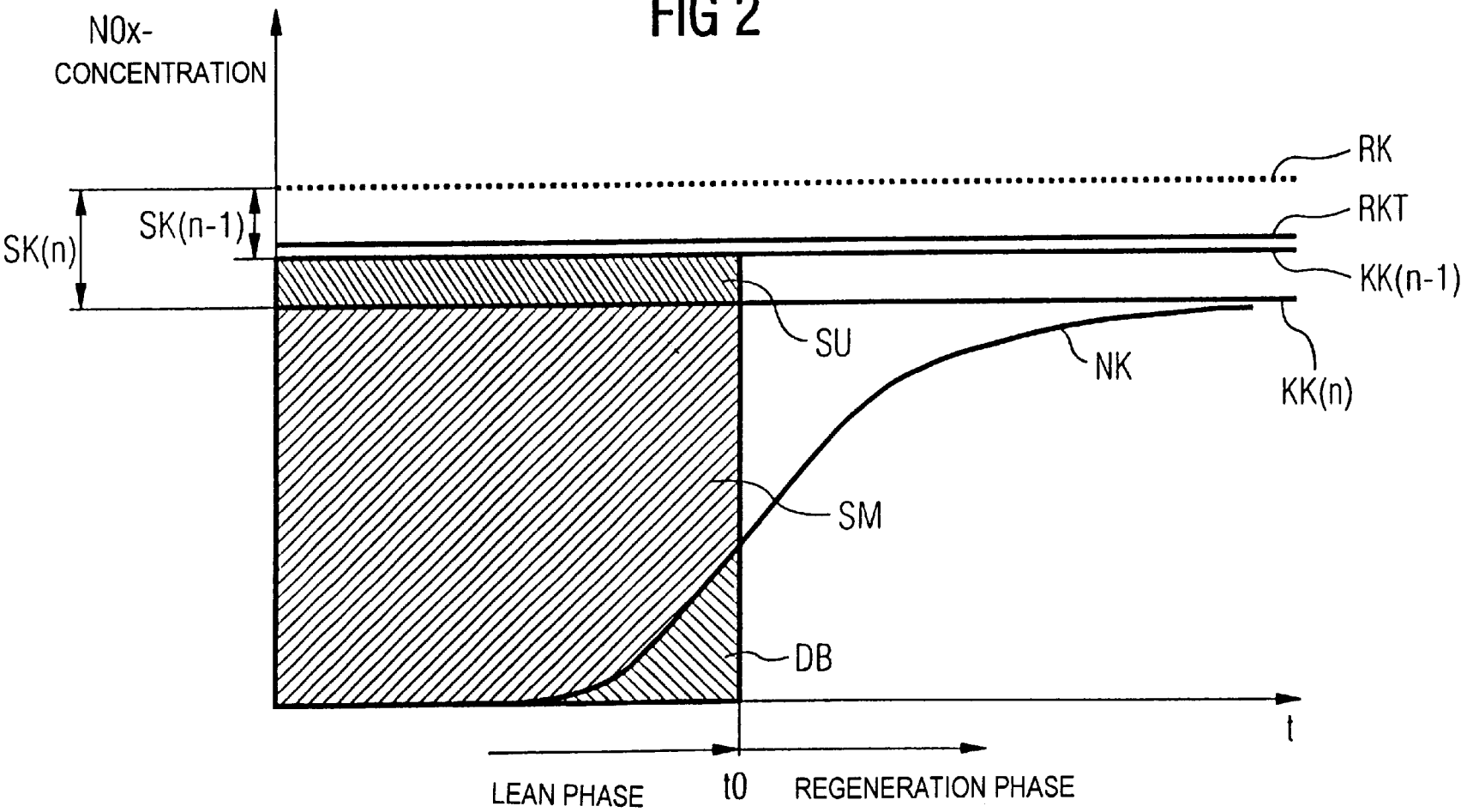
FIG. 2 is a graph illustrating the amount of NOx and the NOx concentration during a lean phase of the internal combustion engine.

FIG. 2 shows a diagram in which the fractions mentioned above of the raw NOx emission emitted by the internal combustion engine during the lean phase are shown. At the time to, the lean phase has been completed and a regeneration phase for the NOx storage catalyst 18 is required. The hatched regions identify the individual amounts of NOx, the steady-state conversion amount SU, the storage amount SM and the leakage amount DB.

Also shown in the diagram are certain fractions of the NOx concentration. Apart from the neither converted nor stored post-catalyst concentration NK, which increases rapidly toward the end of the lean phase, represented as intercepts of the y-axis are the raw NOx concentration RK read out from the characteristic map KF1 and the actual, but not ascertainable, raw NOx concentration RKT. The additionally depicted curve profile for NK after the time to would occur if no regeneration were initiated at the time to.

The designation KK(n−1) denotes the corrected raw NOx concentration before the current adaptation process and KK(n) denotes the corrected raw NOx concentration after the current adaptation. The associated values for the steady-state conversion concentration SK(n−1) with an uncorrected reduction factor and with a corrected reduction factor SK(n) are likewise depicted.

Figure 3:
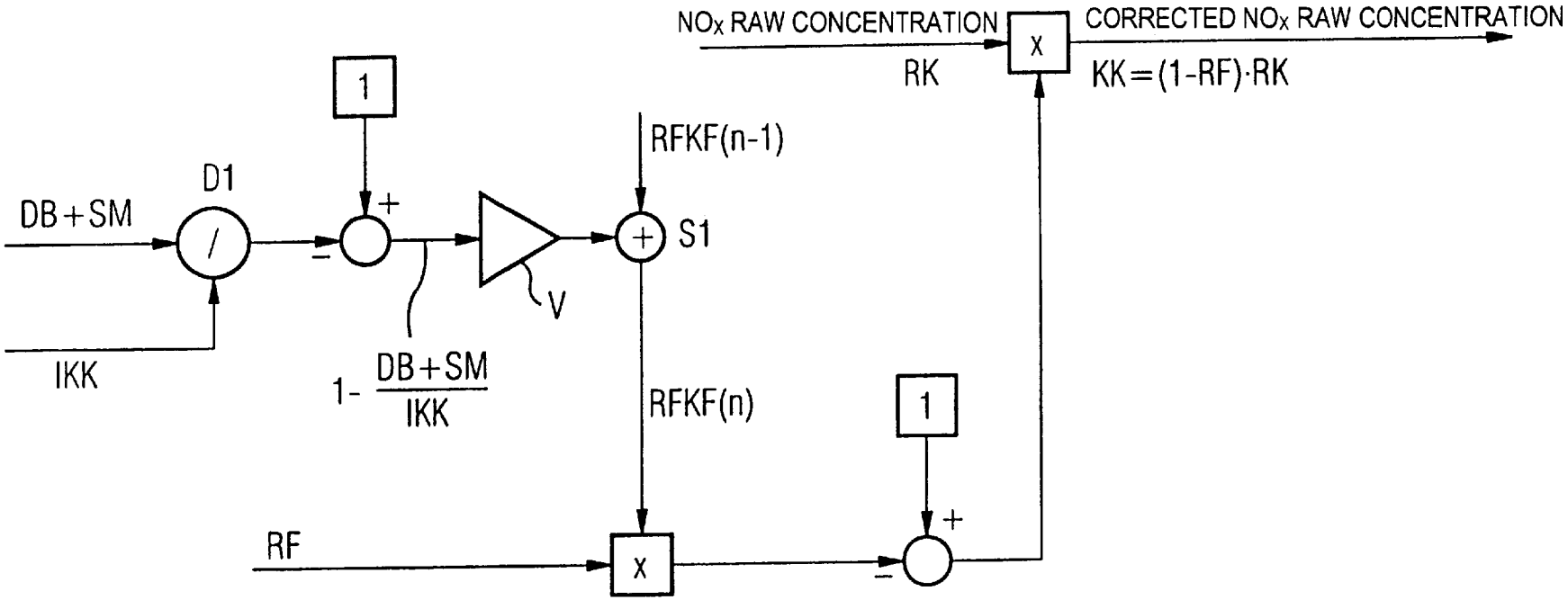
FIG. 3 is a block diagram illustrating the adaptation of the raw NOx concentration values by using a correction factor for the reduction factor.

Represented in FIG. 3 in the form of a block representation is a first exemplary embodiment of the adaptation of the NOx concentration variations by modification of the reduction factor RF, which serves for the calculation of the corrected raw NOx concentration from the raw NOx concentration. The corrected raw NOx concentration KK is in this case ascertained with the aid of the signal of the NOx sensor 21 provided downstream of the NOx storage catalyst and is adapted if necessary.

The adaptation is carried out as follows during a cycle, formed of a lean phase and a rich phase. Firstly, the leakage amount DB and the storage amount SM are ascertained. The leakage amount DB is sensed in the lean phase by measuring the post-catalyst NOx concentration by the NOx sensor 21 and its integration over the duration of the lean phase. The storage amount SM in the lean phase can be calculated in the rich phase following the lean phase. For this purpose, it is assumed that the additional fuel mass flow, not required for stoichiometric combustion, is used for reducing the stored mass of the NOx and for using up the stored oxygen. If the stored amount of oxygen, the time period from the beginning of the rich phase to the detection of complete NOx regeneration of the NOx storage catalyst, the additional fuel mass flow and also the molar ratio of the fuel+NOx reaction are known, the stored amount of NOx can be concluded.

On the basis of the raw NOx concentration RK stored in the characteristic map KF1 and the reduction factor RF stored in a characteristic map KF2, the integral of the corrected NOx concentration over the lean phase IKK is calculated. The raw NOx concentration RK is ascertained for example in dependence on some or all of the following parameters: engine speed, load, ignition angle, air ratio, exhaust recirculation rate, intake-air temperature, coolant temperature.

The sum of the leakage amount DB and the storage amount SM and also the integral value of the corrected NOx concentration over the lean phase IKK are passed to a division stage D1, where the ratio (DB+SM)/IKK is formed. Subsequently, the difference 1−(DB+SM)/IKK is formed and this value is passed to an amplifier element V. If the calculation of the corrected NOx concentration coincides with the not directly reduced NOx concentration ascertained from the probe signals, it follows that IKK=DB+SM. In this case, the value zero is present at the summation point S1 and the correction factor RFKF for the reduction factor RF is not adapted (RFKF(n−1)=RFKF(n)).

If it is established that there is an unacceptable deviation between the value IKK and the sum value DB+SM, the correction factor RFKF for the reduction factor RF, by which the reduction factor RF is multiplied, is reduced or increased in a suitable way. It is reduced if IKK<DB+SM and it is increased if IKK>DB+SM.

It is also possible, instead of forming the ratio of IKK and (DB+SM), to use the difference between IKK and (DB+SM) for determining the increment or decrement by which the correction factor RFKF is changed.

The reduction factor RF read out from the characteristic map KF2, for example as a function of the temperature of the NOx storage catalyst 18, is multiplied by the correction factor RFKF that has remained unchanged or been adapted in the way described above. The value thus obtained is subtracted from 1 and this value is multiplied by the raw NOx concentration RK, which is read out from the characteristic map KF1 for this purpose.

Obtained as the result is a value for the corrected raw NOx concentration KK=(1−RF)*RK.

Figure 4:
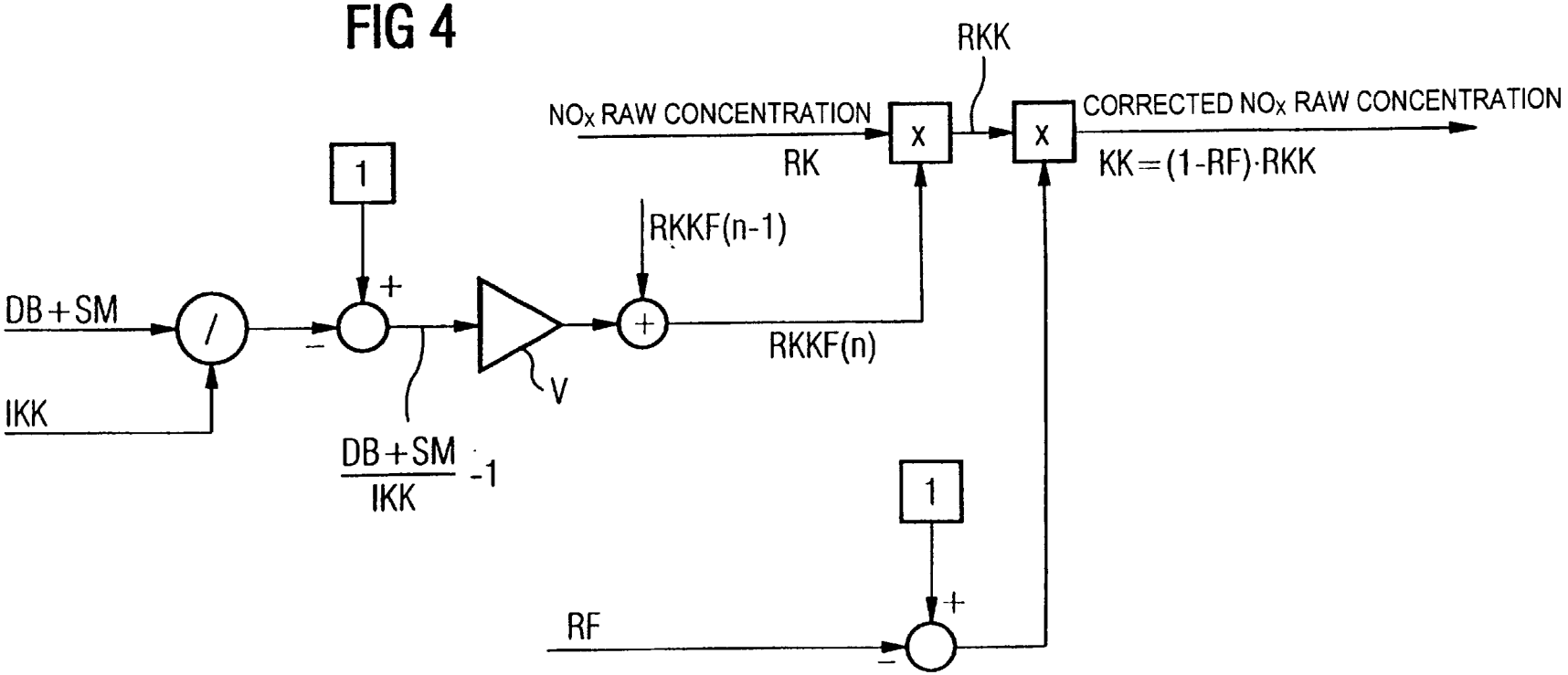
FIG. 4 is a block diagram illustrating the adaptation of the raw NOx concentration values by using a correction factor for the raw NOx concentration values.

Another possibility for adaptation is adaptation of a correction factor RKKF for the raw NOx concentration RK. The method is shown in FIG. 4, likewise in the form of a block representation, and is similar to the method explained with reference to FIG. 3.

However, in the method presented here, the reduction factor RF is not modified, but instead the raw NOx concentration RK is multiplied by a correction factor RKKF that can be calculated by the adaptation method explained above (forming the ratio or difference between IKK and (DB+SM)). Subsequently, this pre-corrected raw NOx concentration RKK is multiplied by the value 1−RF, where RF again denotes the reduction factor, which is read out from the characteristic map KF2. Obtained as the result is a value for the corrected raw NOx concentration KK=(1−RF)*RKK.

Figure 5:
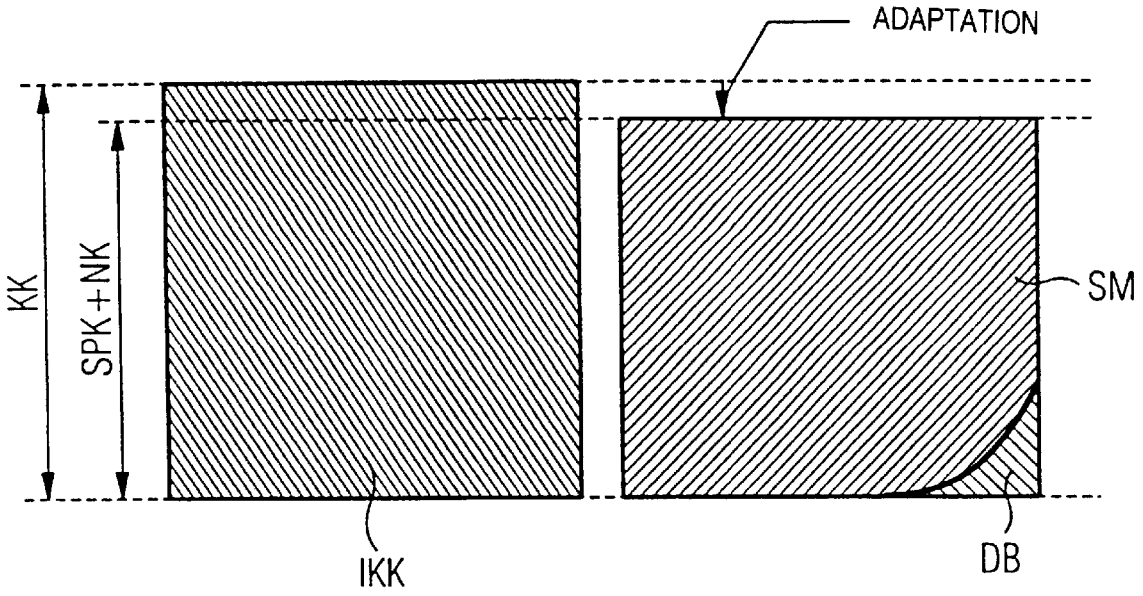
FIG. 5 is a graph illustrating the integrals of the NOx concentrations.

Represented in FIG. 5 are the integrals of the corrected NOx concentration IKK over the lean phase, of the storage amount SM and of the leakage amount DB. Also depicted are the corrected raw NOx concentration KK and the sum of the stored concentration SPK and the post-catalyst concentration NK. In an ideal case, the integral values IKK and SM+DB are equal and no adaptation need be carried out; otherwise, an adaptation is carried out in accordance with the method explained with reference to FIG. 3 or FIG. 4.

We claim:

1. A method for adapting a raw NOx concentration value of an internal combustion engine operating at least in given operating ranges with an excess of air, the method which comprises:

providing an NOx storage reduction catalyst in an exhaust-gas duct of an internal combustion engine;

adsorbing, with the NOx storage reduction catalyst, NOx during a storage phase, when the internal combustion engine is operated with a lean air-fuel mixture;

catalytically converting, with the NOx storage reduction catalyst, NOx stored during the storage phase in a regeneration phase by adding a regenerating agent;

providing an NOx sensor downstream of the NOx storage reduction catalyst;

storing a raw NOx concentration value based on operating parameters of the internal combustion engine in a characteristic map of a memory device of a control device controlling the internal combustion engine;

reading out the raw NOx concentration value from the characteristic map while operating the internal combustion engine; and adapting, during a cycle including the storage phase and the regeneration phase, the raw NOx concentration value read out from the characteristic map based on an output signal of the NOx sensor.

2. The method according to claim 1, which comprises adapting the raw NOx concentration value by changing a reduction factor applied to the raw NOx concentration value, the reduction factor taking into account a steady-state conversion concentration converted by the NOx storage reduction catalyst during a lean operation of the internal combustion engine.

3. The method according to claim 2, which comprises storing the reduction factor in a further characteristic map based on a temperature of the NOx storage reduction catalyst.

4. The method according to claim 2, which comprises:

determining a leakage amount in a lean phase by measuring an NOx concentration downstream of the NOx storage reduction catalyst with the NOx sensor and by integrating the NOx concentration over a duration of the lean phase;

calculating a storage amount in the lean phase during a rich phase following the lean phase;

calculating an integral of a corrected NOx concentration over the lean phase based on the raw NOx concentration value and the reduction factor;

forming a ratio of a sum of the leakage amount and the storage amount to the integral of the corrected NOx concentration over the lean phase;

selectively changing a correction factor for the reduction factor and keeping the correction factor for the reduction factor unchanged dependent on a value of the ratio; and multiplying the reduction factor by the correction factor.

5. The method according to claim 4, which comprises calculating a corrected raw NOx concentration from an adapted reduction factor by calculating a product of a difference between 1 and the adapted reduction factor and the raw NOx concentration value read out from the characteristic map.

6. The method according to claim 1, which comprises multiplying the raw NOx concentration value read out from the characteristic map directly with a correction factor for obtaining a pre-corrected value for a raw NOx concentration; and adapting the raw NOx concentration value by changing the correction factor.

7. The method according to claim 6, which comprises:

sensing a leakage amount in a lean phase by measuring, with the NOx sensor, an NOx concentration downstream of the NOx storage reduction catalyst and by integrating the NOx concentration over a duration of the lean phase;

calculating, during a rich phase following the lean phase, a storage amount in the lean phase;

calculating an integral of a corrected NOx concentration over the lean phase based on the raw NOx concentration value and a reduction factor;

forming a ratio of a sum of the leakage amount and the storage amount to the integral of the corrected NOx concentration over the lean phase; and selectively changing the correction factor for the raw NOx concentration value and keeping the correction factor for the raw NOx concentration value unchanged dependent on a value of the ratio.

8. The method according to claim 7, which comprises calculating a corrected raw NOx concentration from the pre-corrected value for the raw NOx concentration by calculating a product of a difference between 1 and the reduction factor and the pre-corrected value for the raw NOx concentration.

9. The method according to claim 8, which comprises storing the reduction factor in a further characteristic map based on a temperature of the NOx storage reduction catalyst.

* * * * *